United States Patent [19]

Kennedy

[11] 4,116,760

[45] Sep. 26, 1978

[54] METHOD AND APPARATUS FOR REMOVING LIQUID FROM A SLURRY OF SOLID MATERIAL

[75] Inventor: Richard B. Kennedy, Ridgefield, Conn.

[73] Assignee: General Recycling Corporation, Clayton, Mo.

[21] Appl. No.: 694,920

[22] Filed: Jun. 11, 1976

Related U.S. Application Data

[63] Continuation-in-part of Ser. No. 694,099, Jun. 8, 1976, abandoned.

[51] Int. Cl.[2] ..... B30B 9/20; B30B 15/00; B30B 15/30

[52] U.S. Cl. ..... 162/56; 100/37; 100/72; 100/74; 100/120; 100/121; 100/131; 100/153; 100/160; 162/60; 162/190; 162/227

[58] Field of Search ..... 100/37, 72, 74, 90, 100/93 RP, 106, 118, 119, 120, 121, 130, 131, 132, 153, 154, 155 R, 160, 169, DIG. 14; 68/267; 241/21, 25, 28, 68, 69, 101.2; 162/4, 56, 60, 92, 93, 190, 205, 227, 358, 360 R, 361, 363, 373, DIG. 7

[56] References Cited

U.S. PATENT DOCUMENTS

| | | | |
|---|---|---|---|
| 741,980 | 10/1903 | Scanlan | 100/121 X |
| 1,567,489 | 12/1925 | Burt | 100/118 X |
| 2,080,048 | 5/1937 | Kauffman | 68/267 X |
| 2,165,549 | 7/1939 | Hornbostel | 100/131 X |
| 2,408,191 | 9/1946 | Barnett et al. | 100/72 |
| 2,972,378 | 2/1961 | Nuyens | 162/361 |
| 2,694,360 | 11/1964 | Kronlund | 100/121 X |
| 3,140,961 | 7/1964 | Kronlund | 100/118 X |
| 3,198,694 | 8/1965 | Justus | 162/361 X |
| 3,274,924 | 9/1966 | Walker | 100/153 |
| 3,798,121 | 3/1974 | Busker | 162/205 |

FOREIGN PATENT DOCUMENTS 235,754 10/1961 Australia.

*Primary Examiner*—Richard V. Fisher
*Attorney, Agent, or Firm*—Kenyon & Kenyon, Reilly, Carr & Chapin

[57] ABSTRACT

A method of removing liquid from a slurry of solid material in liquid in which the liquid is squeezed from the slurry by passing the slurry through a roll nip and, simultaneously with the squeezing and passing, the liquid squeezed from the slurry is blocked from flowing through the roll nip.

Apparatus for removing liquid from a slurry of solid material in a liquid includes a plurality of liquid guides, disposed in a spaced-apart parallel relationship, being inclined away from and opening adjacent the roll nip.

45 Claims, 9 Drawing Figures

10
11
15
16
18
19
20
22
23
24
25
P

METHOD AND APPARATUS FOR REMOVING LIQUID FROM A SLURRY OF SOLID MATERIAL

BACKGROUND OF THE INVENTION

This application is a continuation-in-part of application Ser. No. 694,099, filed June 8, 1976 for METHOD AND APPARATUS FOR REMOVING LIQUID FROM A SLURRY OF SOLID MATERIAL, now abandoned.

FIELD OF THE INVENTION

The present invention relates generally to a method and apparatus for removing liquid from a slurry of solid material in a liquid, and in particular, to a method and apparatus for removing water from a slurry of paper pulp or fiber in water to facilitate disposal and/or recycling of the pulp.

DESCRIPTION OF THE PRIOR ART

There are, at present, three methods which have been generally used for the disposal of confidential waste paper and the like, namely, shredding, incineration, and pulping. The first of these involves shredding the paper in a shredding machine, after which the shredded paper is disposed of. This method is impractical since the paper must be shredded to a minute size before disposal. Also, an expensive shredding machine must be utilized. In addition, an expensive air handling system is required due to the skiving dust generated by such machines. The costs involved in this method are, thus, prohibitive.

Incineration of paper is also impractical since under environmental regulations open air burning is prohibited and is also ecologically impractical because it totally destroys a reusable product. Also, utilization of this method in the past has demonstrated that it cannot be used effectively.

Finally, the waste paper and the like can be disposed of by forming a slurry of the paper in water, i.e., by "pulping" the paper, and then disposing of the slurry. In such methods waste paper is loaded into a pulper where a slurry of the paper in water is formed. This slurry is then pumped to a water extractor or hydroextractor which reduces the water content of the slurry to about 80% water, 20% pulp solids, by weight. The slurry is then normally disposed of by transporting it to a dump.

Because of the disadvantages associated with incineration and shredding, pulping has become one of the most utilized methods for disposing of confidential waste paper at the present time. This method, as it is now utilized, however, also has several disadvantages. The effluent of the slurry produced cannot be disposed of in a sewage treatment plant in large amounts since it is acidic and contains substantial suspended solids and removed coatings and has a very high basic oxygen demand level and would thus tend to kill the bacteria utilized to treat sewage in the plant. Also, prior art pulping methods and apparatus cannot achieve a reduction of the water content of the slurry to less than about 80% water by weight. As a result, the slurry cannot be baled, and then disposed of in baled form, since its water content is too high. Rather, the slurry must be placed into tub-like vehicles for transporation to a dumping area. Moreover, as a result of its very liquid consistency, the pulp deposited in the dump seeps into the ground and causes pollution of nearby ground water supplies. The slurry cannot be burned by ordinary methods since it is self-extinguishing due to the high water content of the paper pulp.

It is thus apparent that there is a need for an improved method and apparatus for removing water from a slurry of paper pulp in water to enable practical and efficient disposal of waste paper products by pulping.

SUMMARY OF THE INVENTION

It is therefore an object of the present invention to overcome the aforementioned disadvantages of heretofore known methods and apparatus and to provide an improved method and apparatus for removing liquid from a slurry of solid material in liquid.

These and other objects of the invention are achieved in a method of removing liquid from a slurry of solid material in liquid which comprises the steps of squeezing liquid from the slurry by passing the slurry through a roll nip, and simultaneously with the steps of squeezing and passing, blocking liquid squeezed from the slurry from flowing through the roll nip.

In one embodiment of the invention, water is removed from a slurry of solid pulp material in water by forming a roll nip including at least one roll; conveying the slurry to the roll nip; and passing the slurry through the roll nip and squeezing water from the pulp material while simultaneously blocking water squeezed from the pulp material from flowing through the roll nip.

In another embodiment of the invention, pulp material is recycled by forming a thickened slurry of the pulp material in water; conveying the slurry to a roll nip; passing the slurry through the roll nip and squeezing water from the pulp material while simultaneously blocking water squeezed from the pulp material from flowing through the roll nip; and simultaneously with the steps of passing, squeezing and blocking, removing water squeezed from the pulp material from the roll nip.

The foregoing objects are also achieved in an apparatus for removing liquid from a slurry of solid material in liquid in which a roll nip is formed by a pair of resilient surface coverings adapted to conform to, without deforming to, the shape of solids of the slurry for squeezing and removing liquid from the slurry.

In one embodiment of the invention, the apparatus may comprise a first roll nip formed by at least one first roll having a resilient surface covering adapted to conform to, without deforming to, the shape of solids of the slurry for squeezing and removing liquid from the slurry; means for conveying the slurry to the roll nip; and means for removing the liquid squeezed from the slurry from the roll nip.

In another embodiment of an apparatus constructed according to the invention, an inclined conveyor means having a resilient surface covering adapted to conform to, without deforming to, the shape of the pulp material, conveys the slurry of pulp material to a roll nip formed by the conveyor means and a roll which squeezes and removes water from the pulp material. The roll also has a resilient surface covering which is adapted to conform to, without deforming to, the shape of the pulp material and is disposed at one end of the conveyor means in engagement with the resilient surface covering thereof. Drive means are coupled to the roll for driving the roll and the conveyor means and a second roll is disposed vertically below and in engagement with the first roll on which the conveyor means is disposed. A third roll also having a resilient surface covering adapted to conform to, but not deform to, the shape of the pulp material is disposed horizontally adjacent and in engagement with the conveyor means and the second roll and forms a second roll nip for further squeezing the pulp material. A plurality of elongated hollow tube members are disposed in spaced-apart parallel relationship, parallel to and adjacent the conveyor means, and have one end thereof disposed at and opening adjacent the first roll nip. Each of these tube members has an outwardly extending, curved, downwardly directed lip portion which is disposed in engagement with the resilient surface covering of the conveyor means for guiding water squeezed from the pulp material away from the roll nip. A sump means is disposed at the other end of the tube members for collecting water squeezed from the pulp material and guided away from the roll nip by the tube members.

A further embodiment of an apparatus constructed according to the invention, which is suitable for the recycling of solid pulp material, may comprise pulping means for forming a slurry of solid pulp material in water, and means coupled to the pulping means for removing water from the slurry of pulp material. A first roll nip, formed by a pair of resilient surface coverings adapted to conform to, without deforming to, the shape of the pulp material, is disposed adjacent the water removal means for receiving the slurry from the water removing means and squeezing and removing water from the pulp material. Means are disposed adjacent the roll nip for removing water squeezed from the pulp material from the roll nip. Sump means is coupled to the water removing means for collecting water squeezed from the pulp material and removed from the roll nip by the water removing means. Pump means are coupled to the sump means and to the pulping means for pumping water collected by the sump means to the pulping means.

The present invention ovecomes the disadvantages of the foregoing pulping methods since it is extremely efficient and reduces the water content of the slurry to approximately 30–35% by weight. The resulting 65 to 70% solid by weight slurry permits the pulp to be baled and easily transported for disposal. Moreover, the pulp produced by the inventive method and apparatus is washed while it is conveyed to the roll nip by water squeezed from the slurry at the nip and is much brighter than pulp produced by heretofore known methods. Such brighter pulp is very saleable to a paper mill for recycling purposes. Moreover, the inventive method permits the water squeezed from the pulp to be reused in forming a slurry of the waste paper. This feature results in a significant saving of water.

These and other novel features and advantages of the invention will be disclosed in greater detail later on herein in the following detailed description.

BRIEF DESCRIPTION OF THE DRAWINGS

In the drawings, wherein similar reference numerals denote similar elements throughout the several views thereof.

DETAILED DESCRIPTION

Figure 1:
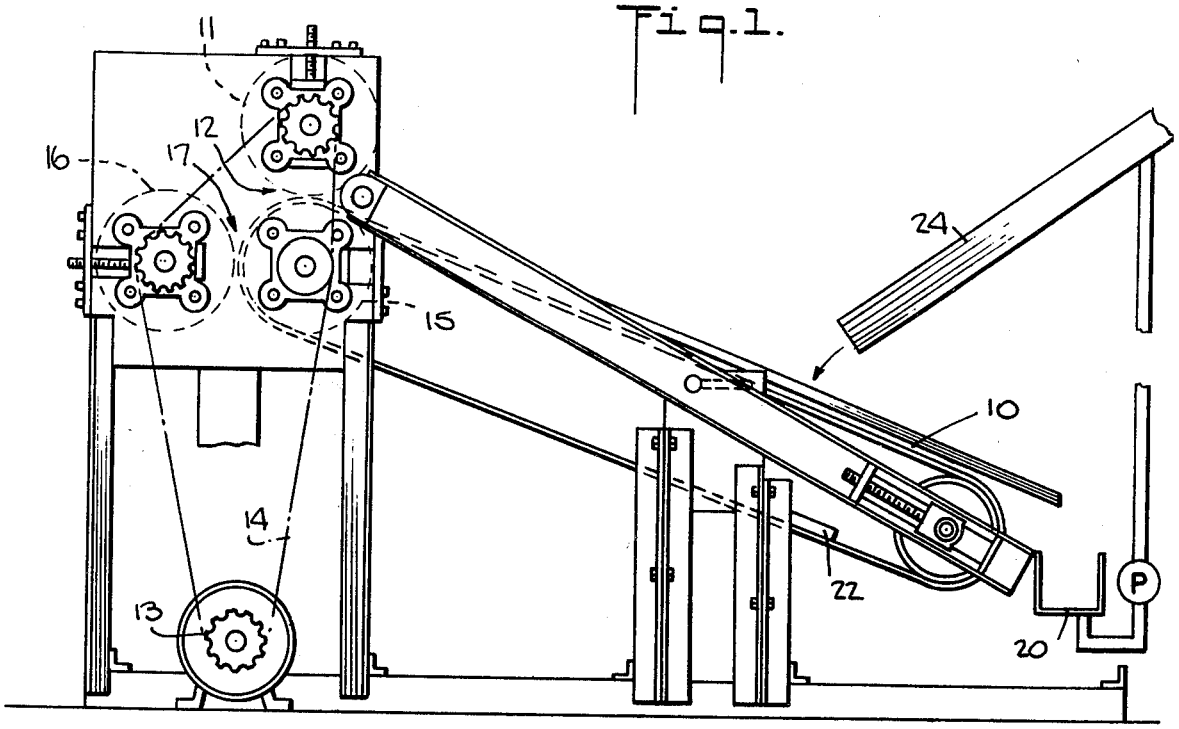
FIG. 1 is a side view of one embodiment of an apparatus for removing liquid from a slurry of solid material in liquid constructed according to the present invention.
Figure 2:
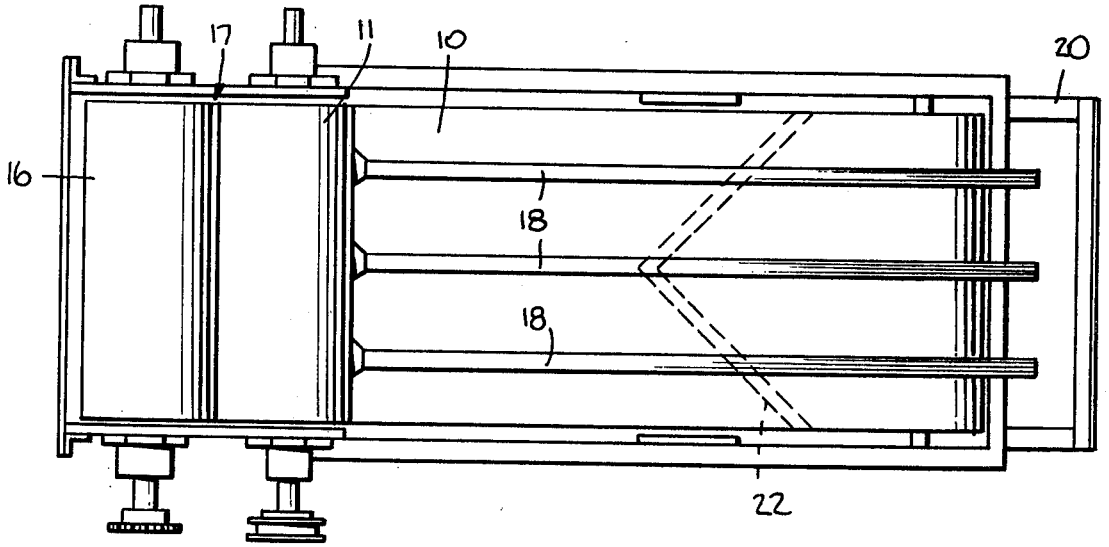
FIG. 2 is a top plan view of the embodiment of the apparatus illustrated in FIG. 1.
Figures 3, 4:
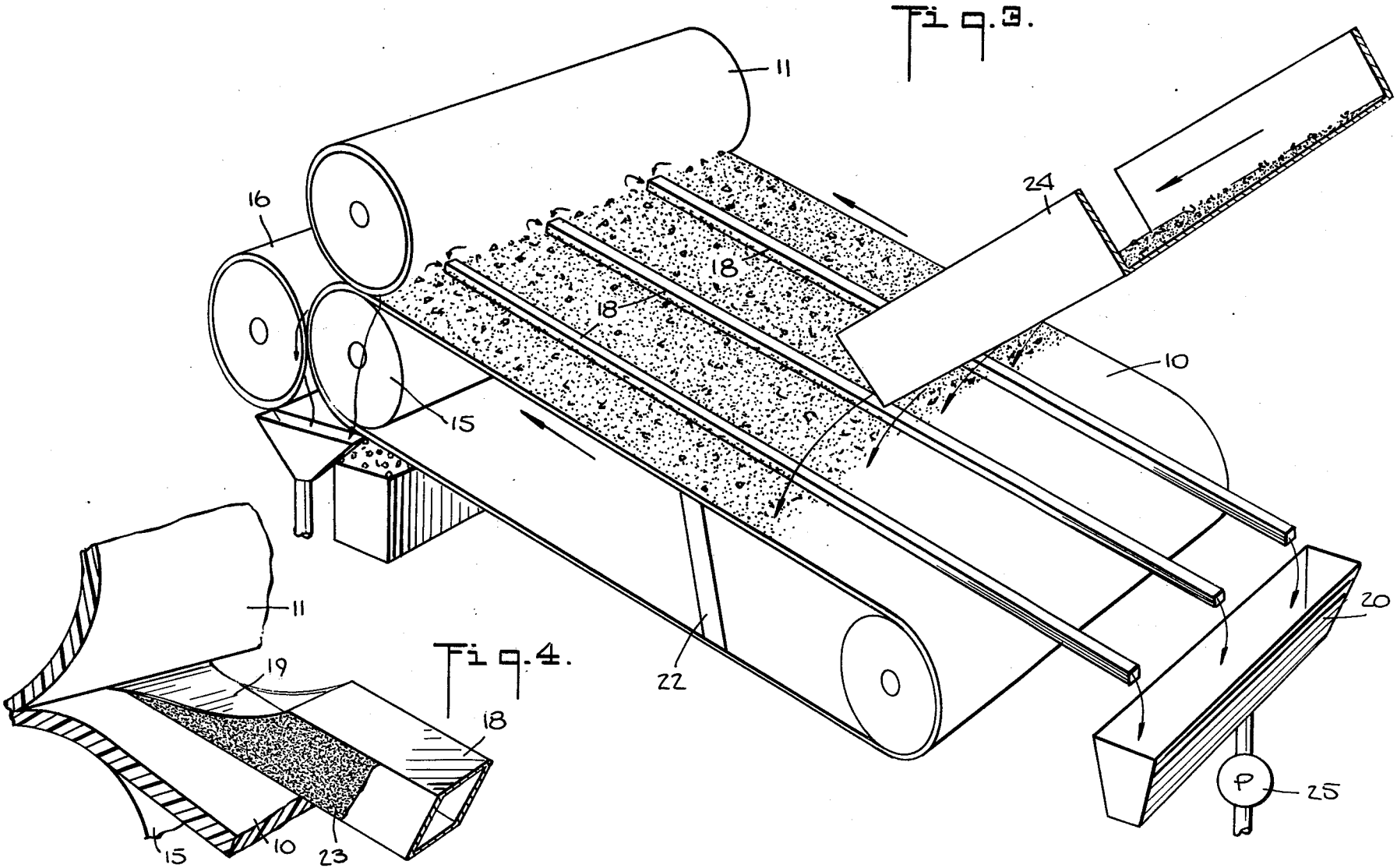
FIG. 3 is a partial, perspective view of the embodiment of the apparatus illustrated in FIG. 1.
FIG. 4 is a partial, perspective view, partly in section, of the liquid guide means of an apparatus constructed according to the present invention.
Figure 5:
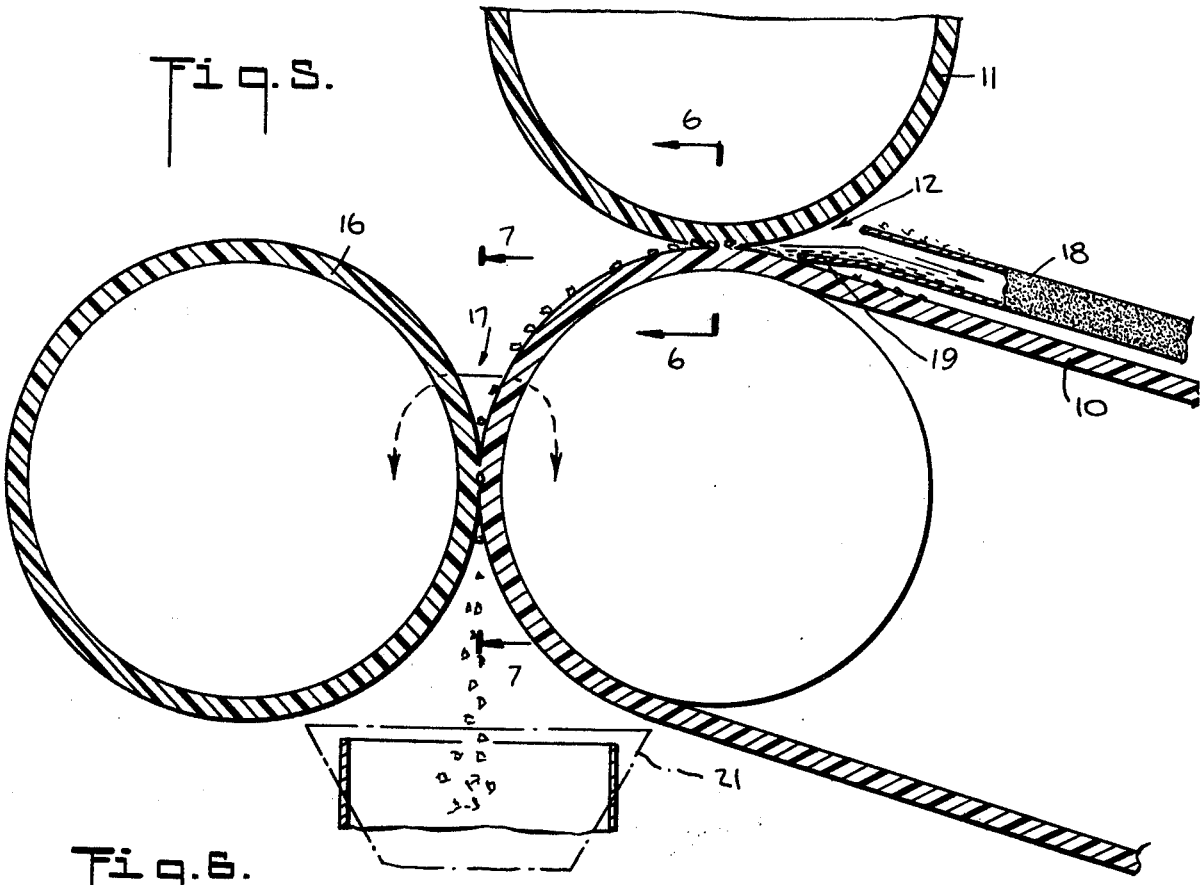
FIG. 5 is a partial, cross-sectional view of the roll nip formed by an apparatus constructed according to the present invention.

Referring now to the drawings, and in particular to FIGS. 1 and 2, there is shown one embodiment of a dewatering apparatus constructed according to the present invention which is particularly adapted for the removal of water from a slurry of paper pulp in water. The apparatus includes a conveyor including an inclined conveyor belt 10 having a resilient surface covering which is adapted to conform to without deforming to, the shape of solid particles, such as particles of pulp material. The surface covering preferably comprises, for example, a coating of urethane having a Shore A hardness ranging between approximately 85 and 90. A roll 11 having the same type of resilient surface covering as belt 10 is disposed at one end of the conveyor belt in engagement with the resilient surface covering of the belt. The roll and the belt form a roll nip 12 which squeezes and removes water from the slurry of pulp material conveyed to the nip by the conveyor belt, which is inclined at an angle towards the nip. Means, comprising, for example, an electric motor 13, is coupled to roll 11 by means of a sprocket and chain drive 14 for driving the roll. Roll 11 drives the conveyor belt by means of frictional engagement between the belt and the roll. The conveyor belt is disposed over a pair of rolls, one of which is roll 15 disposed vertically below and in engagement with roll 11. Roll 15 is not driven by motor 13; it is, rather, an idler roller. Another roll 16 coupled to motor 13 by drive 14 is disposed horizontally adjacent roll 15 in engagement with conveyor belt 10 and roll 15 and also drives conveyor belt 10. This roll also has the same type of resilient surface covering as belt 10 and forms a second roll nip, identified by the reference numeral 17, for further squeezing and removing water from the slurry of pulp material. A plurality of elongated liquid guide means comprising, in the illustrated embodiment of the invention, hollow tube members 18, are disposed in spaced-apart parallel relationship parallel to and adjacent conveyor belt 10 above and spaced apart from the upper outer surface of the belt. These tube members are of square cross section and have one end disposed at and opening adjacent roll nip 12. This end includes an outwardly-extending, curved, downwardly-directed lip portion 19 (shown in FIG. 4) disposed in engagement with conveyor belt 10. A suitable sump 20 is disposed at the other end of the tube members into which the tube members open. The liquid guide means also includes a pair of gutter members 21 disposed on either side of conveyor belt 10 which open adjacent the ends of roll nips 12 and 17. The other end of members 21 open into sump 20 in the same manner as tube members 18.

Rolls 11 and 16 are preferably steel rolls resiliently mounted in engagement with conveyor belt 10 and roll 15 by suitable mounting means, such as, for example, die spring tension and self-aligning bearings which permit adjustment of the roll nip pressure and unequal separation of the rolls from side to side along the longitudinal length of the rolls. The longitudinal length of roll nip 12 would typically be thirty six inches and it has been found that the optimum spacing for tube members 18 is nine inches from center to center. This is so since it has been observed that water squeezed from pulp passing through nip 12 will travel laterally approximately 4½ to 5 inches along the roll nip. Although the angle of inclination of conveyor belt 10 is variable and adjustable the belt is preferably disposed at an angle of approximately 19° with respect to the horizontal. The resilient surface coverings of roll 11, roll 16 and belt 10 may be grooved to facilitate feeding of the slurry conveyed to roll nip 12 and to reduce surface tension between the surface covering and the pulp. An angular scraper, illustrated as a V-shaped scraper bar 22, is disposed within conveyor belt 10 in engagement with the inner surface of the belt for removing pulp from the inner surface of the conveyor belt. Surface tension breaking tapes 23 (shown in FIG. 4) may also be disposed on the side surfaces of tube members 18 for breaking surface tension between the pulp conveyed by conveyor belt 10 and the tube members.

The above-described apparatus is used in conjunction with means for forming a slurry of paper pulp in water, such as, for example, a pulper. The pulper is coupled to a water extractor or hydroextractor, which is known in the art and removes liquid from the slurry of material formed by the pulper. The pulper and hydroextractor are indicated schematically in the drawings by the reference numeral 24 and are disposed adjacent one end of conveyor belt 10. The slurry prepared by the pulper and processed by the hydroextractor is ejected onto belt 10 by means of a chute or a similar device. A suitable pumping means, such as pump 25, is coupled to sump 20 and pumps water collected by the sump to the pulper.

Figure 6:
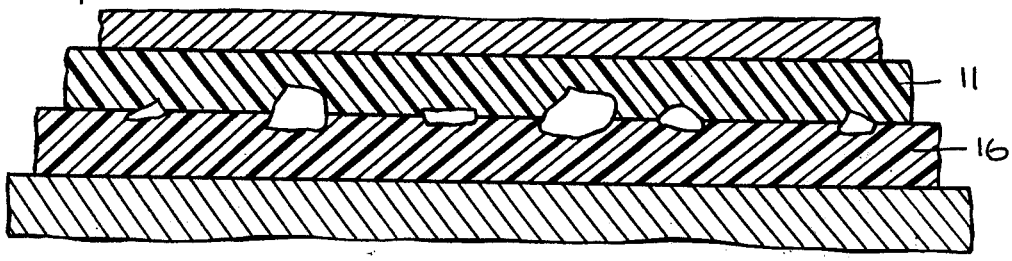
FIG. 6 is a longitudinal, sectional view of the roll nip formed by an apparatus constructed according to the present invention taken along section 6—6 of FIG. 5.
Figure 7:
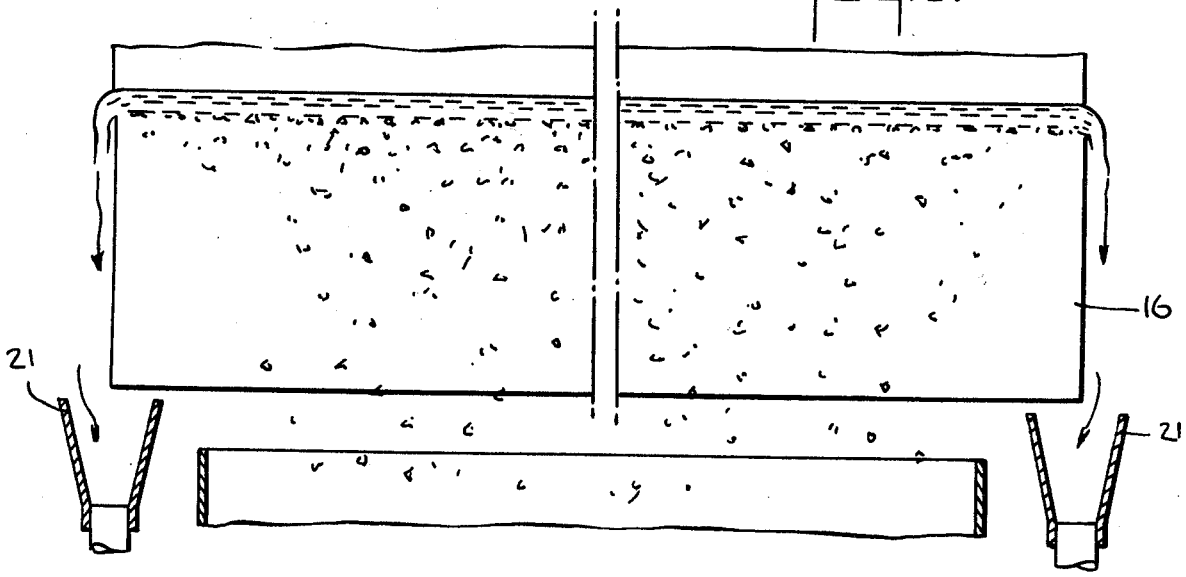
FIG. 7 is a cross-sectional view of the embodiment of the apparatus illustrated in FIG. 1 taken along section 7—7 of FIG. 5.

The operation of the apparatus and the method of the invention will now be described with reference to FIGS. 3 and 5–7:

A slurry of paper pulp in water is formed in the pulper and is pumped to the hydroextractor where the water content of the slurry is reduced, for example, to about 80% by weight, i.e., 20% pulp by weight remains in the slurry. The slurry is ejected in this thickened form from the hydroextractor onto the upper surface of conveyor belt 10 and is conveyed by the conveyor belt in the inclined plane thereof to roll nip 12. The pulp solids of the slurry are passed through the roll nip formed by the resilient surface coverings of the conveyor belt and roll 11, as shown in FIG. 6. Since the resilient surface coverings conform to the shape of the solid particles of pulp material but do not deform thereto, a "damming" effect is obtained. As a result, the pulp is permitted to pass through the nip but water squeezed from the pulp is simultaneously blocked from flowing or passing through the roll nip. Whenever there is no pulp on belt 10, the covering of roll 11 forms a longitudinal dam along the nip. This permits uneven loading of the conveyor belt. The squeezing effect of the roll nip on the pulp solids of the slurry causes water contained in the pulp to flow laterally along the roll nip. As shown in the drawings, this water flows into and is guided away from the roll nip by members 18 and 21. The pulp passing through roll nip 12 is conveyed to second roll nip 17 where it is further squeezed. Substantially all of the water is removed from the pulp of the slurry by roll nip 12, whereat the slurry contains about 65–70% by weight of said pulp material. Water removed from the pulp by nip 17 flows over the edges of the nip and into gutter members 21 which guide the water away from the nip to sump 20. Water collected by sump 20 is pumped back to the pulper by means of pump 25 and is available for forming the slurry. After passage through roll nip 17, the squeezed material can be baled and is subsequently disposed of in this baled form by any suitable means.

The slurry of pulp material being conveyed to roll nip 12 is washed by the liquid squeezed from the solid material during the dewatering process. For example, if the slurry being dewatered is that of printed waste paper in water, the water squeezed from the pulp will be forced at roll nip 12 through the pulp being conveyed to the roll nip and will wash out ink trappings, coatings and clay particles in the pulp. The brightness of the dewatered pulp is, as a result, significantly enhanced.

The guiding away of the liquid squeezed from the slurry by the tube members is an important aspect of the present invention. Unless liquid which is squeezed from the pulp solids of the slurry is quickly and continuously removed from the roll nip, the liquid will greatly inhibit and eventually stop the flow of pulp through the nip rollers due to damming, floating and lubricating of the raw pulp. This is so since if raw pulp is conveyed by belt 10 continously into the water squeezed from the pulp, it will prevent the separated water from passing through it and dam the liquid between the raw pulp and the roll nip. The difference in planes of the conveyor belt and rolls 11 and 15, which are disposed in a vertical plane, form a horizontal shelf which, it has been found, causes the water squeezed from the slurry to travel laterally more effectively for entrance into the tube members and drainage into the sump 20. The water separated from the slurry by the second roll nip 17 flows off the ends of the rolls into members 21. Little, if any, floating, damming or lubricating occurs at this roll nip since the first roll nip 12 separates the bulk of the water from the pulp.

The mounting of the rolls in resilient engagement with the conveyor belt permits uneven separation of the rolls from side to side and permits the integrity of the dam formed by roll nip 12 to be maintained even though, for example, a thin piece of pulp passes through one side of the nip and a very thick piece passes through the other side. Also, this arrangement causes all torsional loads to be reacted in the side plates of the machine apparatus instead of transmitting the loads throughout the entire frame of the machine. Moreover, the driving of the conveyor belt 10 by means of rolls 11 and 16 in frictional engagement therewith prohibits slippage which would occur if the belt were driven by roll 15 alone. It should be noted that the angle of inclination of the conveyor belt towards roll nip 12 is not critical, but merely must be sufficient to achieve the proper drainage of the water from the roll nip 12 into tube members 18 and gutter members 21. Also, the type of surface covering used on conveyor belt 10 and roll 11 is not critical, but merely must be adapted to conform to the size of the particles passing therethrough without deforming to the shape of the particles. Such materials should have a deformation characteristic similar to that of urethane which will retain its "memory" under conformations of about 25% of the thickness of the coating utilized. Suitable materials would be rubber, synthetic rubber, etc.

Figure 8:
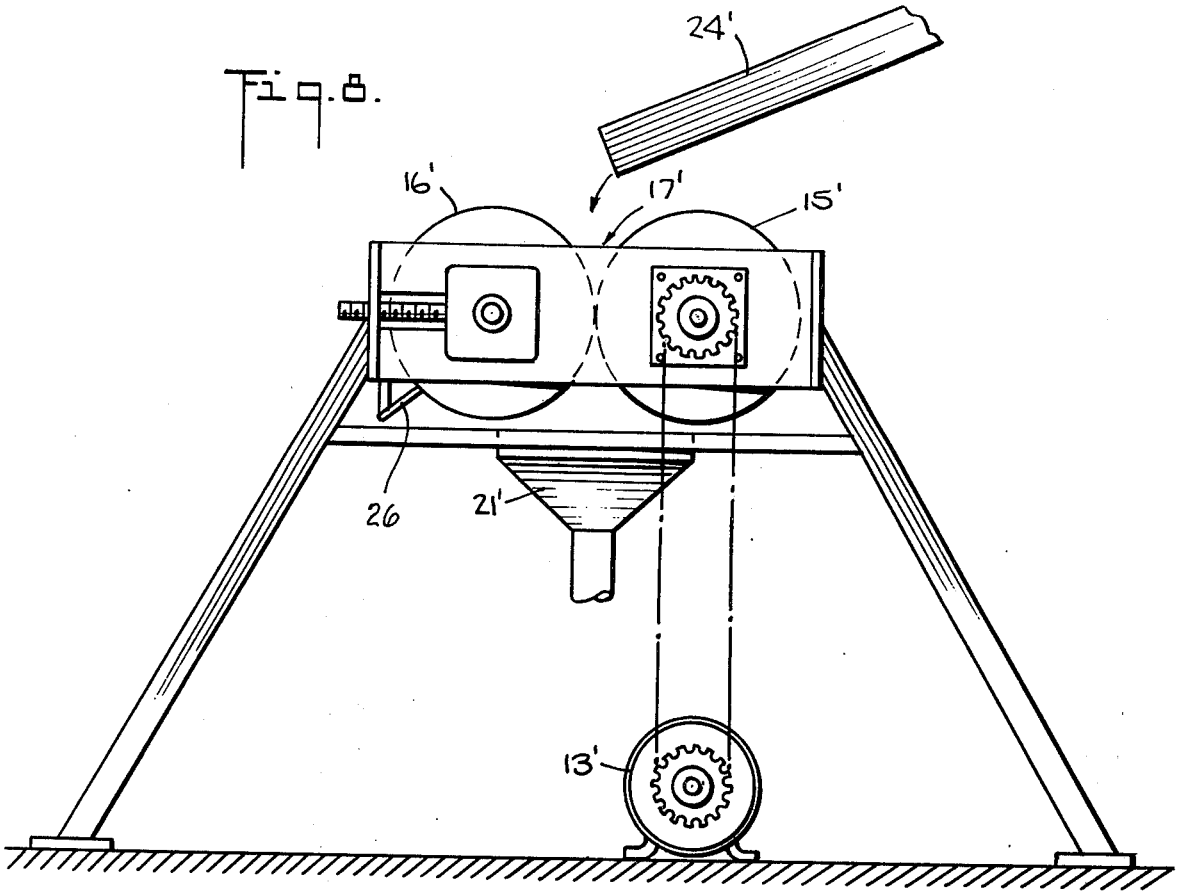
FIG. 8 is a side view of another embodiment of an apparatus for removing liquid from a slurry of solid material in liquid constructed according to the present invention.
Figure 9:
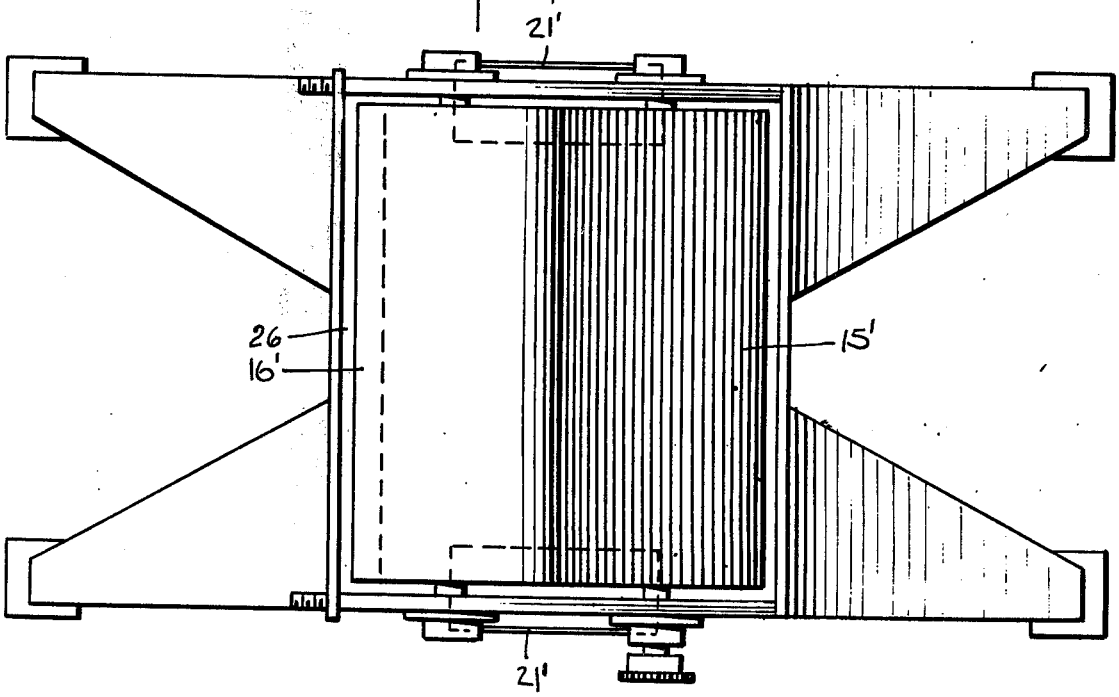
FIG. 9 is a top plan view of the embodiment of the apparatus illustrated in FIG. 8.

FIGS. 8 and 9 illustrate another embodiment of a dewatering apparatus constructed according to the invention. In this embodiment, a pair of steel rolls 15' and 16' each have a resilient surface covering which is the same as that of rolls 11 and 16 and belt 10 illustrated in FIGS. 1–7 and are mounted in a horizontal plane adjacent and in engagement with one another so as to form a roll nip 17'. A pulper and hydroextractor 24' is disposed adjacent the nip and conveys the slurry into the roll nip. A drive means, such as, for example, electric motor 13', is coupled by a chain and sprocket drive to roll 15' which drives idler roll 16' by means of the frictional engagement of roll 15' with roll 16'. Roll 16' is preferably resiliently mounted in engagement with roll 15' in the same manner as rolls 11 and 15 previously described herein. A doctor blade 26 is mounted on the apparatus in engagement with roll 16' for removing pulp which adheres to the smooth surface of the roll. Roll 15' has a patterned or grooved surface for reducing surface tension between the rolls and the amount of pulp adhering to the roll. The grooved surface of roll 15' also provides a more efficient feed of the pulp to the roll nip. Gutter members 21' are disposed adjacent the ends of rolls 15' and 17' for removing water squeezed from the pulp to a sump for disposal. The sump may be coupled to a pump similar to the embodiment of the invention illustrated in FIG. 3 for pumping to a pulper.

The operation of this embodiment of the invention is as follows:

A slurry of pulp material having a water content of about 80% by weight is conveyed to nip 17' by hydroextractor and pulper 24' which ejects the slurry and causes it to fall downwardly into nip 17'. Similar to the previously described embodiment of the invention, water is squeezed from the pulp by passing the pulp through the roll nip which reduces the water content of the slurry to about 30–35% by weight. The resilient surface coverings of rolls 15' and 16', similar to the previously described embodiment of the invention, permit the pulp material to pass through the nip but simultaneously block the water squeezed from the pulp from flowing through the nip. The water squeezed from the pulp material then flows over the edges of rolls 15' and 16' forming the nip into gutter members 21' and is thereby removed from the nip. The dewatered pulp of the slurry which adheres to roll 16' is scraped from the roll by doctor blade 26. The operation of this embodiment of the invention is similar in all other respects to the apparatus described with reference to FIGS. 1–7 previously herein.

The resilient surface coverings of the rolls enable the integrity of the dam produced by the roll nip to be maintained independently of the varying size of the pulp particles simultaneously fed through the nip. The rolls utilized may be of any diameter. Reducing the diameter of the rolls will reduce the amount of pulp which can be dewatered by the apparatus but reducing the speed of the roll rotation will increase its capacity. Capacity can also be increased by adding pairs of rolls to the apparatus, using rolls of a larger diameter or length, or any combination thereof.

It should be noted that although the invention has been described with reference to the dewatering of a slurry of paper pulp in water, the invention can also be used to dewater other slurries of material in water such as slurries of kelp, bark, and sludge.

In the foregoing specification, the invention has been described with reference to specific exemplary embodiments thereof. It will be evident, however, that various changes and modifications may be made thereunto without departing from the broader spirit and scope of the invention as set forth in the appended claims. The specification and drawings are, accordingly, to be regarded in an illustrative rather than in a restrictive sense.

What is claimed is:

1. A method of removing liquid from a slurry of solid material in liquid, comprising the steps of:

conveying said slurry to a roll nip in an inclined plane by an inclined conveyor means, squeezing liquid from said slurry by passing said slurry through said roll nip, simultaneously with said step of squeezing and passing, blocking liquid squeezed from said slurry from flowing through said roll nip, and simultaneously with said steps of squeezing and blocking, removing liquid squeezed from said slurry from said roll nip by guiding liquid squeezed from said slurry away from said roll nip in said inclined plane at selected intervals along the length of said nip by a plurality of liquid guide means, disposed in spaced-apart parallel relationship, parallel to said inclined plane, and each having one end thereof disposed at and opening adjacent to said roll nip.

2. The method recited in claim 1, further comprising the step of forming said roll nip, prior to said step of squeezing, from at least one roll having a resilient surface covering adapted to conform to, without deforming to, the shape of solid material of said slurry.

3. The method recited in claim 2, wherein said step of forming comprises forming said roll nip from said roll and said conveyor means.

4. The method recited in claim 3, further comprising, simultaneously with said steps of squeezing and blocking, the step of washing solid material of said slurry conveyed to said roll nip by forcing, at said roll nip, liquid squeezed from said slurry through said solid material conveyed to said roll nip.

5. A method of removing water from a slurry of solid pulp material in water, comprising the steps of:

forming a roll nip including at least one roll, conveying the slurry by an inclined conveyor means in an inclined plane to said roll nip, passing said slurry through said roll nip and squeezing water from said pulp material, while simultaneously blocking water squeezed from said pulp material from flowing through said roll nip, and simultaneously with said step of passing, squeezing and blocking, removing water squeezed from said pulp material from said roll nip by guiding water squeezed from said pulp material away from said roll nip in said inclined plane at selected intervals along the length of said roll nip by a plurality of water guide means, disposed in spaced-apart, parallel relationship, parallel to said inclined plane, and each having one end thereof disposed at and opening adjacent to said roll nip.

6. The method recited in claim 5 wherein said step of forming said roll nip comprises forming said roll nip from said roll and said conveyor means, said roll and said conveyor means each having a resilient surface covering adapted to conform to, without deforming to, the shape of said pulp material.

7. The method recited in claim 6, further comprising, simultaneously with said step of passing, squeezing and blocking, the step of washing said pulp material conveyed to said roll nip by forcing, at said roll nip, water squeezed from said pulp material through said pulp material conveyed to said roll nip.

8. A method of recycling pulp material, comprising the steps of:

forming a thickened slurry of said pulp material in water previously squeezed from said pulp material, conveying said slurry to a roll nip in an inclined plane by an inclined conveyor means, passing said slurry through said roll nip and squeezing water from said pulp material, while simultaneously blocking water squeezed from said pulp material from flowing through said roll nip, and simultaneously with said step of passing, squeezing and blocking, removing water squeezed from said pulp material from said roll nip by guiding water squeezed from said pulp material away from said roll nip in said inclined plane at selected intervals along the length of said nip by a plurality of water guide means disposed in spaced-apart parallel relationship, parallel to said inclined plane, and each having one end thereof disposed at and opening adjacent to said roll nip.

9. The method recited in claim 8, wherein said step of forming comprises forming a thickened slurry containing less than about 20% by weight of said pulp material.

10. The method recited in claim 8, wherein said step of passing, squeezing and blocking further comprises the step of squeezing water from said pulp material until said slurry contains about 65–70% by weight of said pulp material.

11. The method recited in claim 8, wherein said step of forming comprises forming a slurry of said pulp material in water and removing water from said slurry of pulp material until said slurry contains about 20% by weight of said pulp material to form a thickened slurry of said pulp material in water.

12. The method recited in claim 8, further comprising the step of collecting said water squeezed from said pulp material and subsequently forming a further slurry of said pulp material in said water squeezed from said pulp material.

13. The method recited in claim 8, further comprising the steps of:

conveying, subsequent to said step of removing, said squeezed pulp material to a second roll nip, passing said squeezed pulp material through said second roll nip and further squeezing said pulp material, baling said squeezed pulp material, and subsequently disposing of said baled pulp material.

14. The method recited in claim 8, further comprising subsequent to said step of forming the thickened slurry, the step of forming a roll nip from at least one roll having a resilient surface covering adapted to conform to, without deforming to, the shape of said pulp material.

15. The method recited in claim 14, wherein said step of forming said roll nip comprises forming said roll nip from said roll and said conveyor means, said conveyor means also having a resilient surface covering adapted to conform to, without deforming to, the shape of said pulp material.

16. The method recited in claim 15, further comprising, simultaneously with said step of passing, squeezing and blocking, the step of washing said pulp material conveyed to said roll nip by forcing, at said roll nip, water squeezed from said pulp material through said pulp material conveyed to said roll nip.

17. An apparatus for removing liquid from a slurry of solid material in liquid, comprising:

a first roll nip formed by at least one first roll having a resilient surface covering adpated to conform to, without deforming to, the shape of solids of said slurry for squeezing and removing liquid from said slurry;

means for conveying said slurry to said roll nip comprising an inclined conveyor means having one end thereof disposed adjacent said roll nip, means for removing liquid squeezed from said slurry from said roll nip comprising elongated liquid guide means disposed in spaced-apart, parallel relationship at selected intervals along the length of said roll nip, parallel to and adjacent said conveyor means, and each having one end thereof disposed at and opening adjacent to said roll nip.

18. The apparatus recited in claim 17, wherein said conveyor means comprises a conveyor belt having a resilient surface covering adapted to conform to, without deforming to, the shape of solids of said slurry, and wherein said roll nip is formed by said first roll and said conveyor belt.

19. The apparatus recited in claim 18, further comprising means, coupled to said first roll, for driving said first roll, said conveyor belt being disposed in engagement with said first roll and said first roll thereby driving said conveyor belt.

20. The apparatus recited in claim 19, further comprising means for resiliently mounting said roll in engagement with said conveyor belt.

21. The apparatus recited in claim 18, further comprising a second roll, disposed vertically below and in engagement with said first roll, said conveyor belt being disposed over said second roll, and a third roll disposed horizontally adjacent and in engagement with said conveyor belt and said second roll, forming a second roll nip for further squeezing said slurry.

22. The apparatus recited in claim 21, further comprising means for resiliently mounting said first roll in engagement with said conveyor belt and said second roll, and means for resiliently mounting said third roll in engagement with said conveyor belt and said second roll.

23. The apparatus recited in claim 18, further comprising means, disposed within said conveyor belt and engaging one of the inner surfaces thereof, for scraping said slurry from said inner surfaces of said belt.

24. The apparatus recited in claim 17, further comprising a second roll, disposed horizontally adjacent and in engagement with said first roll, said second roll having a resilient surface covering adapted to conform to, without deforming to, the shape of solids of said slurry, said first and second rolls forming said roll nip.

25. The apparatus recited in claim 24, further comprising means for resiliently mounting one of said rolls in engagement with the other of said rolls.

26. The apparatus recited in claim 24, further comprising means, coupled to said first roll for driving said first roll, said first roll being disposed in engagement with said second roll and thereby driving said second roll.

27. The apparatus recited in claim 26, further comprising means, disposed in engagement with said second roll, for scraping said slurry from the surface of said second roll.

28. The apparatus recited in claim 17, wherein said resilient surface covering disposed on said first roll is grooved.

29. The apparatus recited in claim 17, wherein said liquid guide means comprise a plurality of spaced-apart, hollow tube members each having an outwardly-extending, curved, downwardly-directed lip portion disposed at the end thereof opening adjacent said roll nip in engagement with said conveyor means.

30. The apparatus recited in claim 29, further comprising means, disposed on said hollow tube members, for breaking surface tension between said tube members and said slurry conveyed to said roll nip by said conveyor means.

31. An apparatus for removing water from a slurry of solid pulp material in water, comprising:

an inclined conveyor means having a resilient surface covering adapted to conform to, without deforming to, the shape of said pulp material for conveying said slurry of pulp material;

at least one first roll having a resilient surface covering adapted to conform to, without deforming to, the shape of said pulp material, disposed at one end of said conveyor means in engagement with said resilient surface covering of said conveyor means, said conveyor means and said first roll forming a first roll nip for squeezing and removing water from said pulp material;

means, coupled to said first roll, for driving said first roll and said conveyor means;

a second roll, disposed vertically below and in engagement with said first roll, said conveyor means being disposed over said second roll;

a third roll, having a resilient surface covering adapted to conform to, but not deform to, the shape of said pulp material, disposed horizontally adjacent and in engagement with said conveyor means and said second roll, forming a second roll nip for further squeezing said pulp material;

a plurality of elongated, hollow tube members, disposed in spaced-apart parallel relationship, parallel to and adjacent said conveyor means and each having one end thereof disposed at and opening adjacent said first roll nip, each of said tube members having an outwardly-extending, curved, downwardly-directed lip portion disposed in engagement with said resilient surface covering of said conveyor means for guiding water squeezed from said pulp material away from said roll nip; and sump means, disposed at the other end of said tube members for collecting water squeezed from said pulp material and guided away from said roll nip by said tube members.

32. The apparatus recited in claim 31, further comprising means for resiliently mounting said first roll in engagement with said conveyor means and said second roll, and means for resiliently mounting said third roll in engagement with said conveyor means and said second roll.

33. The apparatus recited in claim 31, wherein said resilient surface covering of said first roll is grooved.

34. The apparatus recited in claim 31, wherein said conveyor means includes a conveyor belt, and further comprising an angular scraper means, disposed within and engaging one of the inner surfaces of said conveyor belt, for scraping pulp material from said inner surfaces of said conveyor belt.

35. The apparatus recited in claim 31, further comprising means, disposed on said hollow tube members, for breaking surface tension between said pulp material and said tube members.

36. An apparatus for recycling solid pulp material, comprising:

pulping means for forming a slurry of solid pulp material in water;

first means, coupled to said pulping means, for removing water from said slurry of pulp material;

a first roll nip formed by a pair of resilient surface coverings adapted to conform to, without deforming to, the shape of said pulp material, disposed adjacent said first water removing means for receiving said slurry from said first water removing means and squeezing and removing water from said pulp material;

second means, disposed adjacent said roll nip, for removing water squeezed from said pulp material from said roll nip;

sump means, coupled to said second water removing means, for collecting water removed from said roll nip by said second water removing means; and pump means, coupled to said sump means and to said pulping means, for pumping water collected by said sump to said pulping means.

37. The apparatus recited in claim 36, further comprising an inclined conveyor, having one end thereof disposed adjacent said first water removing means, for receiving and conveying said slurry from said first water removing means to said roll nip, and wherein said roll nip comprises at least one first roll, disposed in engagement with the other end of said conveyor, forming said roll nip with said conveyor.

38. The apparatus recited in claim 37, wherein said second water removing means comprises a plurality of elongated water guide means disposed in spaced-apart parallel relationship at selected intervals along the length of said roll nip, parallel to and adjacent said conveyor, and each having one end thereof disposed at and opening adjacent to said roll nip, said sump means being disposed at the other end of said water guide means for collecting water guided away from said roll nip by said water guide means.

39. The apparatus recited in claim 38, wherein said first roll and said conveyor each have a resilient surface covering adapted to conform to, without deforming to, the shape of particles of said pulp material, for forming said roll nip.

40. The apparatus recited in claim 39, further comprising:

means, coupled to said first roll, for driving said first roll and said conveyor;

a second roll, disposed vertically below and in engagement with said first roll, said conveyor being disposed over said second roll; and a third roll, having a resilient surface covering adapted to conform to, without deforming to, the shape of particles of said pulp material, disposed horizontally adjacent and in engagement with said second roll and said conveyor, forming a second roll nip for further squeezing said pulp material.

41. The apparatus recited in claim 40, further comprising means for resiliently mounting said first roll in engagement with said conveyor and said second roll, and means for resiliently mounting said third roll in engagement with said conveyor and said second roll.

42. The apparatus recited in claim 39, wherein said resilient surface covering of said first roll is grooved.

43. The apparatus recited in claim 39, wherein said conveyor includes a conveyor belt, and further comprising means, disposed on one of the inner surfaces of said conveyor belt, for scraping pulp material from said inner surfaces of said conveyor belt.

44. The apparatus recited in claim 39, wherein said water guide means comprise elongated, hollow tube members each having an outwardly-extending, curved, downwardly-directed lip portion disposed at the end thereof opening adjacent said first roll nip in engagement with said conveyor.

45. The apparatus recited in claim 44, further comprising means, disposed on said tube members, for breaking surface tension between said pulp material and said tube members.

* * * * *